United States Patent [19]

Ieda

[11] 4,117,282

[45] Sep. 26, 1978

[54] SWITCH TIME-DELAY MECHANISM FOR TOY GUN

[75] Inventor: Michael Ieda, Ft. Solanga, N.Y.

[73] Assignee: Ideal Toy Corporation, Hollis, N.Y.

[21] Appl. No.: 770,885

[22] Filed: Feb. 22, 1977

[51] Int. Cl.[2] ..... H01H 7/08; F21L 13/00; A63F 9/02

[52] U.S. Cl. ..... 200/33 R; 42/1 A; 200/61.45 R; 200/61.53; 273/101.1; 362/112

[58] Field of Search ..... 42/1 A; 362/110–114; 273/101.1; 200/33 R, 34, 61.45 R, 61.53, 52 R

[56] References Cited

U.S. PATENT DOCUMENTS

| | | | |
|---|---|---|---|
| 1,432,254 | 10/1922 | Paterson et al. | 362/112 |
| 1,699,595 | 1/1929 | Lamont | 362/110 |
| 2,269,258 | 1/1942 | Falkenberg | 318/480 X |
| 2,275,150 | 3/1942 | Kenney et al. | 362/112 |
| 2,928,190 | 3/1960 | Evans | 273/101.1 |
| 2,934,634 | 4/1960 | Hellberg | 362/113 |
| 3,417,237 | 12/1968 | Fenton | 362/112 |
| 3,655,192 | 4/1972 | Hall et al. | 200/34 X |

*Primary Examiner*—James R. Scott

*Attorney, Agent, or Firm*—Richard M. Rabkin

[57] ABSTRACT

A timing mechanism for controlling actuation of a switch in a toy gun in order to produce a burst of light of a predetermined duration includes a housing and a switch actuating member movably mounted in the housing for movement between first and second positions. The switch actuating member is located to engage the switch during a portion of its movement and it is biased to its first position by a spring or the like. An impeller arrangement is provided for driving the switch control member from its first towards its second position against the bias of the spring; and an inertia element, such as a flywheel, operatively engaged with the switch control member, is driven by the switch control member as it moves from its first position towards its second position. The inertia element aids in driving the switch control member to its second position and resists return movement of the switch control member, under the influence of the spring, from its second to its first position, thereby to control the duration of time during which the control member closes the switch and thus control the duration of the burst of light produced by the toy gun.

18 Claims, 7 Drawing Figures

SWITCH TIME-DELAY MECHANISM FOR TOY GUN

The present invention relates to target shooting games and, in particular, to a timing mechanism for use in a simulated gun adapted to be used in a particular type of target shooting game.

BACKGROUND OF THE INVENTION

Target shooting games of various types have been proposed in the past for use in commercial establishments such as penny arcades and also in the home. These devices take a variety of forms, with the typical commercial type of shooting gallery game using a light source to project a beam of light towards a target which includes a photocell that, when hit by the beam of light, activates a signal mechanism. In commercial types of target games the mechanism for producing the beam of light is relatively complex and the current is continuously supplied to the light bulb's filament so that the filament is heated continuously but to a level which produces little or no light. However with the heated filament, when the gun is actuated an intense beam of light, of extremely short duration, is produced. Thus the gun must be properly aimed during the short period of time in which the light beam of an intensity sufficient to actuate the photocell is produced. This prevents the player from sweeping the gun around or about the target over an extended period of time in an attempt to align the gun properly with the target. Thus a high degree of skill is necessary in hitting the target and these games closely simulate actual target shooting games with real guns.

While the commercial target shooting games are highly satisfactory in use, they are unsuitable for home entertainment products. They are exceedingly complex and require substantial maintenance, and of course are relatively expensive. To avoid these difficulties a home target shooting amusement game has been proposed which uses a novel arrangement for signaling a hit on the target. This amusement game is disclosed in U.S. patent application Ser. No. 659,216 filed Feb. 19, 1976 and commonly assigned herewith. The disclosure of that application is incorporated herein by reference.

In U.S. patent application Ser. No. 659,216 a target shooting amusement apparatus is disclosed in which a toy gun is used to produce a short burst of light that is directed at a target on which a series of tin cans or bottles are placed. When the light beam hits a photocell associated with a respective can or bottle, an impeller mechanism associated with the housing on which the cans and bottles are mounted causes movement of the "hit" can or bottle to simulate a hit. In one embodiment the game provides a simulated fence on which the cans or bottles are mounted and the impeller mechanism knocks the cans or bottles off the fence when the photocells are hit. In this game, as in the commerical shooting gallery games, it is desirable that the burst of light used to actuate the photocells have an extremely short, predetermined duration so that the gun must be accurately aimed for a short period of time in order to register a hit. If the light beam is on for too long a period of time the player could move the gun about the target until the light beam is aligned with the photocell. This would reduce the need for skill in aiming the gun properly.

With a home entertainment game of this type, it is undesirable that the light bulb producing the beam of light be on constantly, even at a low intensity as in commercial shooting gallery games, since that would reduce the life of the bulb, or require that special and highly expensive light bulbs be utilized. Thus it is desirable that the light producing mechanism of the game have a bulb which is only energized when the gun is actuated. However, with conventional incandescent bulbs which would be suitable for use in this type of game, current must be supplied to the bulb for a minimum period of time in order that the filament of the bulb be heated sufficiently to produce light. Thus it is desirable that the actuating mechanism of the gun insure that current is supplied to the bulb for a period of time which is greater than that which is necessary for the filament of the bulb to become sufficiently heated to produce light, but less than a given maximum period of time, so that the resulting light beam has a predetermined length thereby to require accurate aiming of the gun.

SUMMARY OF THE INVENTION

Accordingly, it is an object of the present invention to provide a timing mechanism for actuating a light bulb in a toy gun to produce a light burst of predetermined duration.

Another object of the present invention is to provide a switch actuating mechanism which is adapted to selectively actuate a switch for a given controllable period of time.

Yet another object of the present invention is to provide a timing mechanism of the character described which is relatively simple in operation and economical to produce.

A still further object of the present invention is to provide a timing mechanism of the character described which is durable in operation.

In accordance with an aspect of the present invention a timing mechanism is provided for use in a toy gun of a shooting gallery game wherein the gun includes a housing, a light source, and a power supply connected to the light source through a normally open switch. The timing mechanism includes means for closing the switch for a short predetermined period of time sufficient to permit the filament of the light bulb to be heated and produce light, and to maintain the light for a short period of predetermined duration. This switch control arrangement includes an elongated switch control bar which is slidably mounted in the gun housing for movement between first and second positions with respect to the switch to contact and close the switch during a predetermined portion of the bar's movement. A spring biases the bar to its first position, and impeller means are provided for driving the bar from its first towards its second position against the bias of the spring. An inertia element, such as a flywheel is operatively engaged with the slide bar and driven thereby during movement of the slide bar from its first towards its second position. The rotation of the flywheel and its resulting inertia aid in driving the bar to its second position and then resists return movement of the slide bar under the bias of the spring means from its second to its first position. As a result the slide bar is maintained in contact with the switch for a predetermined period of time in order to produce the desired short burst of light of predetermined duration.

BRIEF DESCRIPTION OF THE DRAWING

The above, and other objects, features and advantages of this invention will be apparent in the following detailed description of an illustrative embodiment thereof, which is to be read in connection with the accompanying drawings, wherein.

DESCRIPTION OF THE PREFERRED EMBODIMENTS

Figure 1:
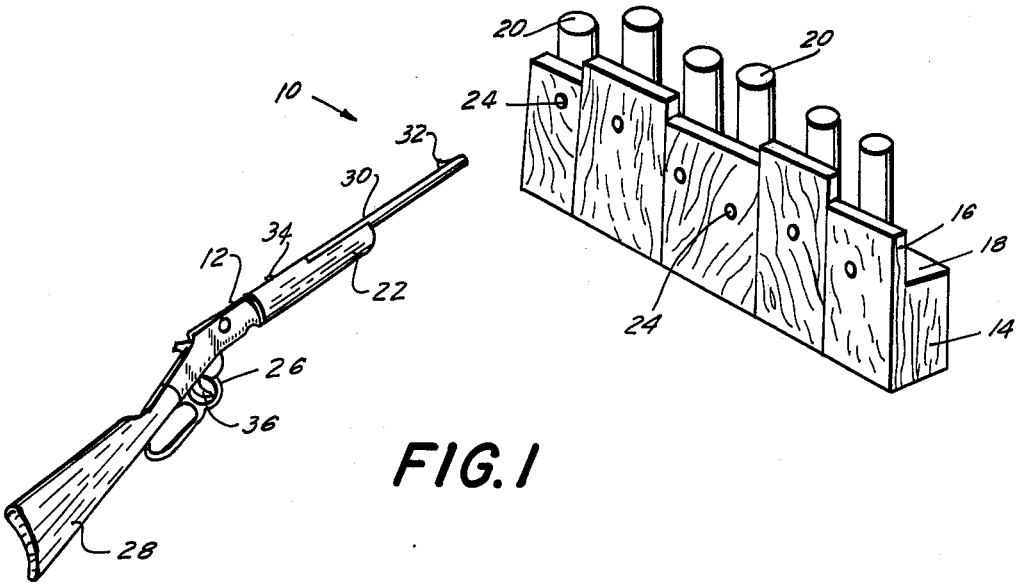
FIG. 1 is a perspective view of a shooting gallery game of the type in which the timing mechanism of the present invention is adapted to be used.
Figure 4:
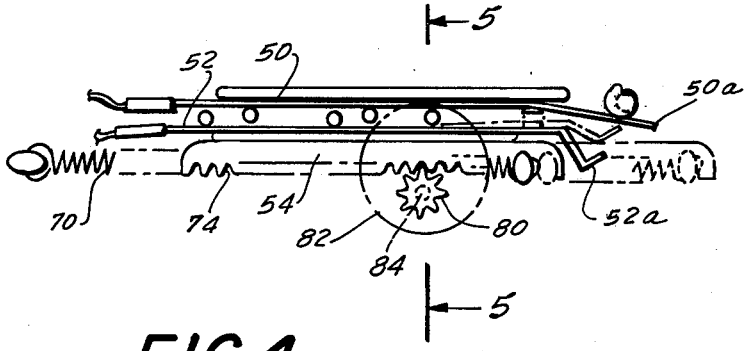
FIG. 4 is a side view, similar to FIG. 3A, but with a portion of the housing removed, showing movement of the switch control bar after impact by the impeller mechanism.
Figure 5:
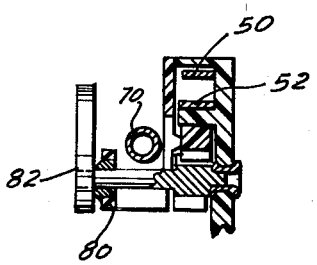
FIG. 5 is a sectional view taken along line 5—5 of FIG. 4.

Referring now to the drawing in detail, and initially to FIG. 1 thereof, a target game apparatus 10 in which the timing mechanism of the present invention is adapted to be used includes a simulated rifle 12 and a target support frame 14. The target support frame is formed as a simulated fence having a front wall 16 and a rear housing 18. A plurality of target objects such as tin cans 20 are seated on the top wall of housing 18 in back of the fencelike front wall 16. In operation a beam of light from rifle 12, exiting from the front end of the front stock 22 of the rifle enters through one of a plurality of apertures 24 in fence 16 when the rifle is properly aimed at the respective target 20, thereby to cause the target to be knocked off of housing 18 as if it were actually hit by a projectile from the rifle. The basic mechanism for this game, including the rifle structure and the arrangement for knocking the targets or tin cans off of the fence is described in the above identified application and reference is made thereto for a specific description of the structure.

Rifle 12 includes a cocking mechanism 26, the front stock 22 and a rear stock portion 28. The rifle also includes a simulated barrel 30 which extends forwardly of the front stock 22 and has a sighting tip 32 on the end thereof that aligns with a viewfinder 34 on stock 22. When the rifle is properly aligned with one of the target objects 20 and the trigger 36 of the cocking mechanism, is actuated, a beam of light is produced from a light bulb 37 located within stock 22, and the light beam is projected towards one of the photocell openings 24. The light bulb within stock 22 is a conventional incandescent light bulb which is electrically connected to one or more batteries (through wires 39) which are located either in front stock 22 or in the rear stock 28. The supply of current to the light source is controlled by the timing mechanism 40 of the present invention illustrated in detail in FIGS. 2 and 3.

Timing mechanism 40 is located within the central portion of the rifle between the front and rear stocks. The mechanism is contained within a housing 42 on which the cocking lever 44 of cocking mechanism 26 is rotatably mounted, as for example by a pivot pin or rivet 46. A normally open switch 48 in the timing mechanism is connected between the batteries or source of electrical current and the incandescent light bulb used to produce the desired burst of light. The electrical circuit for this arrangement can be essentially the same as the electrical circuit used in the rifle of the above mentioned patent application.

Switch 48 includes a pair of spaced contact members 50, 52. The contact member 52 has a bent free end 52*a* which is located to be in the path of travel of a switch actuating bar or member 54. The free end 50*a* of the switch contact element 50 is straight, but is biased by a stop member 56 or the like towards the free end 52*a* of the other spring contact to insure contact between the two elements, when the contact element 52*a* is engaged by bar 54, as described hereinafter.

Figures 2, 2A:
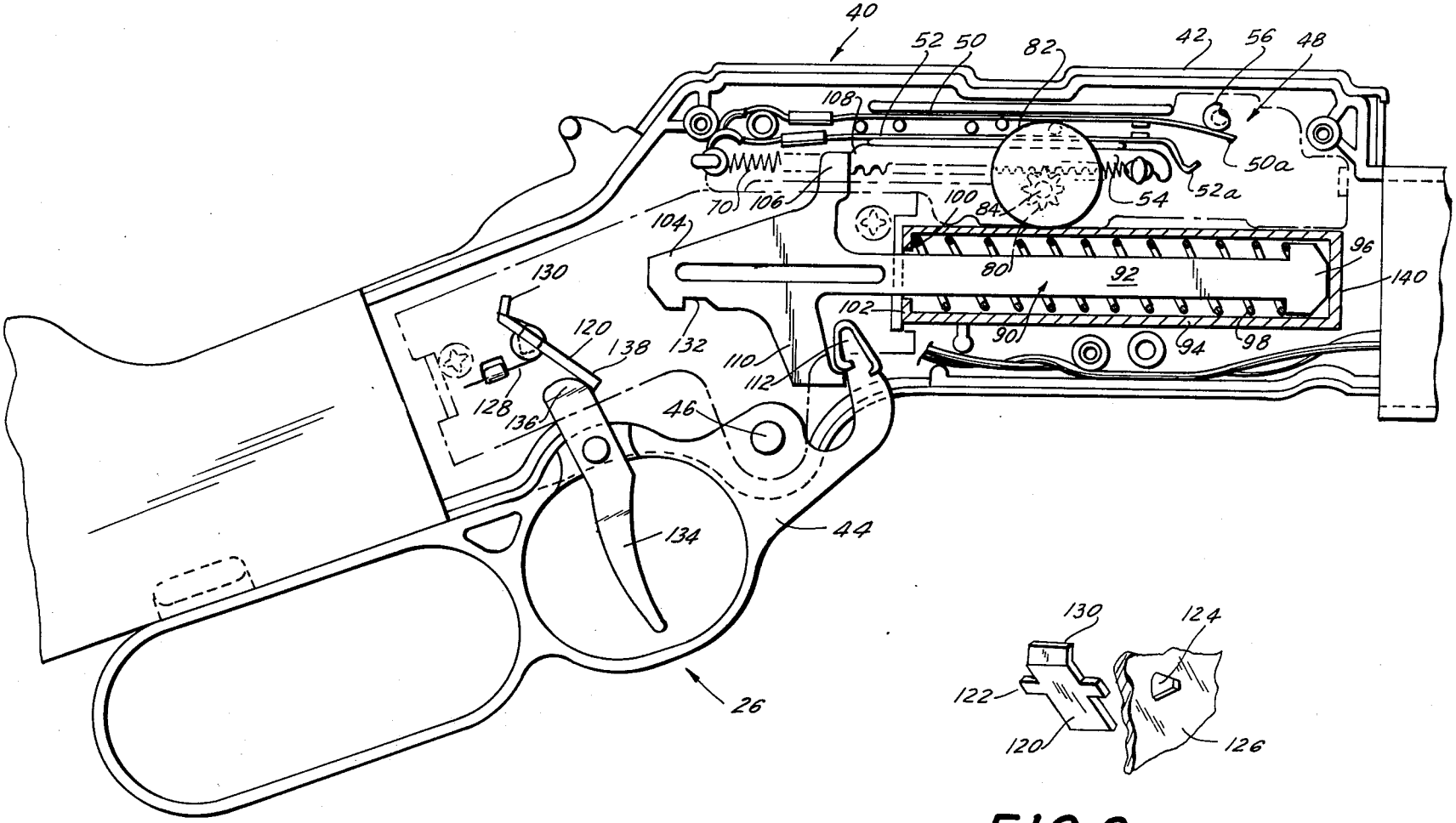
FIG. 2 is an enlarged side sectional view of the toy gun illustrated in FIG. 1 showing the timing mechanism of the present invention prior to actuation.
FIG. 2A is a partial exploded perspective view of a latch member and its mounting used in the gun of FIG. 2.
Figures 3, 3A:
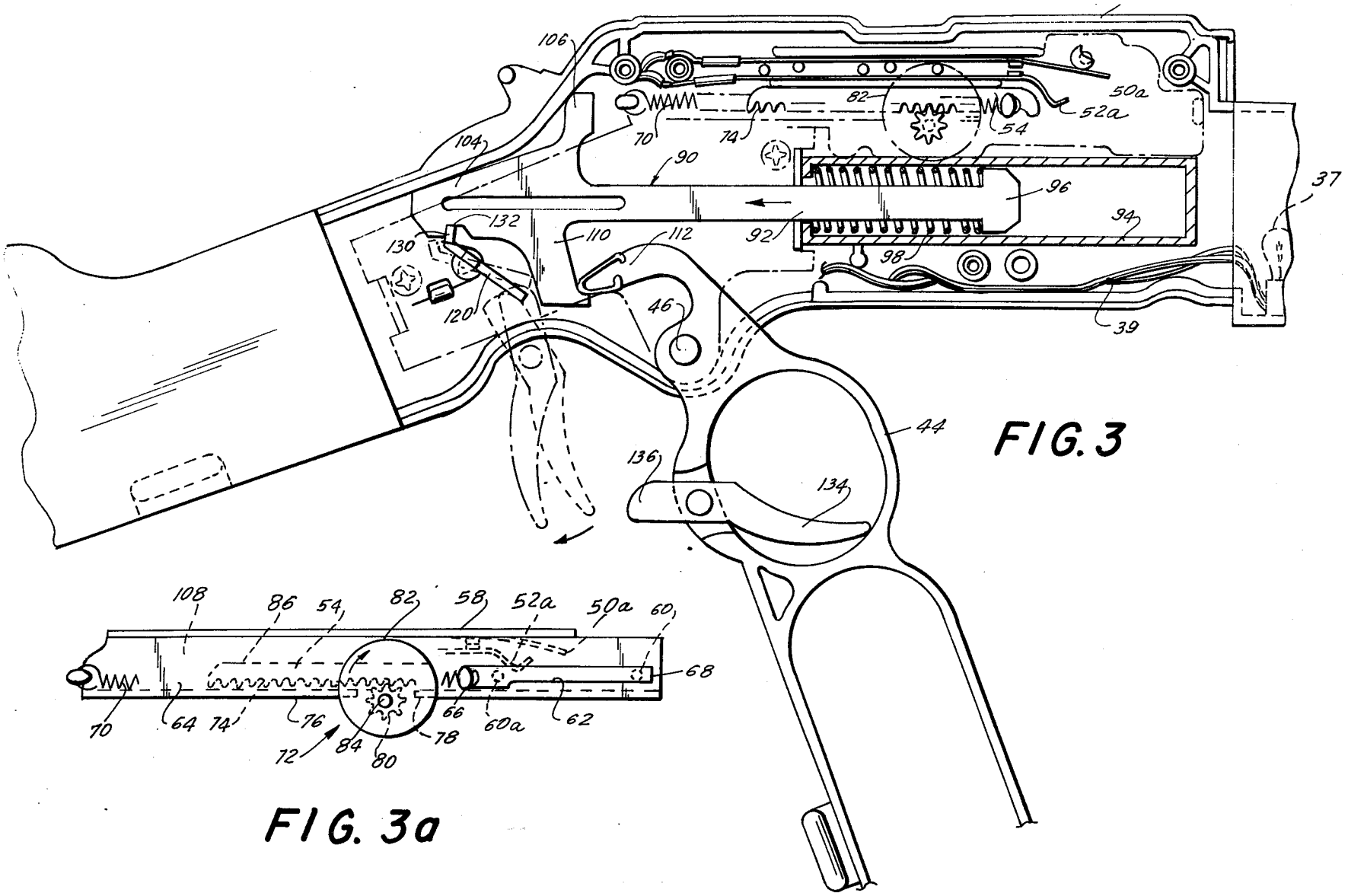
FIG. 3 is a side sectional view similar to FIG. 2, showing the cocking of the timing mechanism before firing of the gun.
FIG. 3A is a partial side view of a portion of the timing mechanism showing the housing arrangement which defines the first and second positions of the slide bar switch control element of the timing mechanism.

Bar 54 is slidably mounted within a sub-housing section 58 of housing 40, as seen in FIG. 3. It is noted that in FIGS. 2 and 3 the side wall of the sub-housing 58 has been removed to expose the slide bar 54. The latter has an extension or abutment element 60 which extends laterally away from the bar through a slot 62 formed in the front wall 64 (see FIG. 3A) of sub-housing 58. Slot 62 has opposed ends 66, 68 which define, respectively, the first and second positions of the slide bar 54 and limit sliding movement of the bar within the housing to between those two positions. As will be appreciated from FIG. 3*a* when slide bar 54 is moved from the position illustrated, wherein abutment 60 is located against end 66 of slot 62 to its second position wherein abutment 60 is located against end 68 of slot 62 the switch contact element 52*a* is moved upwardly as a result of its engagement with bar 54, thereby to engage contact 50*a* and close the circuit to supply current to the light bulb. The switch will remain closed as long as a portion of the contact bar engages contact end 52*a*. Thus, by adjusting the speed of movement of contact bar 54 with respect to the switch contact ends 52*a*, 50*a*, the period of time during which current is supplied to the light bulb can be controlled.

Control bar 54 is normally maintained in or adjacent its first position, wherein abutment 60 is adjacent end 66 of slot 62 by a spring 70. When slide bar 54 is moved to the right in FIG. 3*a* by the impeller mechanism described hereinafter, spring 70 is extended and, when movement of bar 54 is stopped after abutment 60 hits end 68 of slot 62, the spring serves to draw the slide bar back to its first position. The movement of the slide bar to its second position is aided by an inertia mechanism 72 associated with the slide bar 54, which also serves to restrain return movement from its second to its first position.

Slide bar 54 has a plurality of gear teeth 74 formed on its lower side which rest on the bottom surface 76 of the sub-housing 58. That bottom surface has an opening 78 formed therein through which a spur gear 88 extends. The spur gear 80 is rotatably mounted in housing 40 in any convenient manner. As a result of the engagement between spur gear 80 and rack teeth 74 on bar 54, when the bar is moved from its first to its second position, i.e. to the right in FIG. 3A, gear 80 is rotated. This gear is rigidly connected in any convenient manner to a flywheel 82 which is preferably mounted eccentrically on a common shaft 84 with spur gear 80. The flywheel is preferably formed of a heavy material such as brass.

By this arrangement when slide bar 54 is moved from its first to its second position, i.e. moved towards the right in FIG. 3A, flywheel 82 is driven in a clockwise direction, developing substantial inertia. The inertia imparted to the flywheel 82 insures that the slide bar 54 is driven all the way to the right in FIG. 3*a* until abutment 60 engages end 68 of slot 62, even though the force applied to the slide bar, as described hereinafter, is not continuously supplied to the bar but rather is applied to the bar over only a relatively short distance of its movement. The inertia of flywheel 82 wants to continue to drive bar 54 to the right even though movement of the bar is stopped by end 68 of slot 62. Thus the flywheel resists, initially, withdrawal of the slide bar from its second position back to its first position by spring 70. Once spring 70 overcomes this inertia of the flywheel and begins moving slide bar 54 to the left in FIG. 3*a* the fly-wheel 82 commences rotating in a counterclockwise direction and, because of its weight, represents a drag on or resistance to the movement of the slide bar towards the left. Thus the flywheel retards movement of the slide bar. In this manner, the time during which upper surface 86 of slide bar 54 is engaged with spring contact 52*a*, closing the switch 48, is controlled by flywheel 82. This time period can be extended by extending slot 62, or it can be decreased by decreasing the length of slot 62. Thus the switch control mechanism permits the time during which current is supplied to the incandescent lamp to be accurately controlled so that current is supplied only for a time sufficient to warm the filament of the incandescent bulb so that it will produce light and to keep current supplied to the heated filament only for an extremely short period of time sufficient to produce a short burst of light.

The drive or impeller arrangement for slide bar 54 is actuated by cocking mechanism 26 and includes a slide plate 90 having an elongated stem 92 contained within a closed cylinder 94. The free end 96 of stem 92 has a head formed thereon which engages one end of a spring 98. The opposite end 100 of the spring 98 bears against end 102 of cylinder 92, so that spring 98 normally biases slide plate 90 into the position illustrated in FIG. 2.

The left end 104 of slide plate 90 includes an abutment 106 which is located to engage the end 108 of slide bar 54 in order to drive the slide bar as described hereinafter. In addition end 104 of the slide plate 90 has an extension 110 which cooperates with the end 112 of cocking lever 44. By this arrangement when the cocking lever is pivoted about rivet 46, from the position shown in FIG. 2 to the position shown in FIG. 3, the end 112 of the lever bears against extension 110 of slide plate 90 and moves the slide plate to the left in the drawings, against the bias of spring 98. When slide plate 90 has been moved to its extreme left position, illustrated in FIG. 3, by actuation of cocking lever 44, the plate is locked in position by a latch 120. The latter has a pair of side arms 122 (see FIG. 2*a*) of generally rectangular configuration which are respectively received in generally triangularly shaped slots 124 formed in a pair of plates 126 located within housing 40. (It is noted that only one of the plates 124 is shown in FIG. 2*a*). In this manner latch 120 is limited in pivotal motion to one of two positions illustrated in solid and phantom lines respectively in FIG. 3. The lever is however biased to a first position, illustrated in solid lines in FIGS. 2 and 3 by a spring 128. In this position, latch 120 is located such that its upper end 130 will be engaged in recess 132 on the rear end 104 of slide plate 90 when the plate is moved to its leftmost position, as illustrated in FIG. 3. Thus the latch locks plate 90 in that first position against the bias of spring 98.

When cocking lever 44 is returned to its normal position illustrated in FIG. 2, trigger 134, which is pivotally mounted on cocking lever 44, is positioned such that its end 136 is located adjacent end 138 of latch 120. This is shown in dashed lines in FIG. 3 and in solid lines in FIG. 2. When a person using the rifle in the game pulls trigger 134, i.e. pivots the trigger in a clockwise direction from the dashed line position of FIG. 3 to the phantom line position thereof, the upper end 136 of the trigger moves latch 120 in a counterclockwise direction to its second limiting position as defined by triangular slots 124, against the bias of spring 128, thereby releasing the end 130 of the latch from notch 132. As a result plate 90 is free to move from its first position illustrated in FIG. 3 to its second position, under the impulse provided by spring 98.

As plate 90 moves to the right, from the position shown in FIG. 3 to the position shown in FIG. 2 and approaches the end of its movement it is moving very rapidly and the extension or abutment 106 thereof engages end 108 of bar 54. The extension 106 remains engaged with end 108 of bar 54 for a very short distance, before the end 96 of the plate engages the end 140 of cylinder 94, thereby stopping the plate's movement. However the impact provided by plate 90 on bar 54 and the small joint movement of plate 90 and bar 54 impart movement and momentum to flywheel 82 which continues to drive bar 54 as described above.

In the illustrative embodiment of the invention, when plate 90 is moved to the left, bar 54 is freed to move further under the influence of spring 70 such that its abutment 60 engages end 66 of slot 62. When trigger 134 is fired the extension 106 on plate 90 engages the end 108 of bar 54 and drives it to the right as described above. However after about an additional ¼ inch of movement or less, plate 90 is stopped, as described above and bar 54 continues to move to the right under the momentum imparted to flywheel 82. When bar 54 returns to the left, movement of the bar is stopped when end 108 thereof engages extension 106 of plate 90. In that position abutment 60 is located in the position shown in dotted lines identified by the legend 60*a*, in FIG. 3. Then, when the rifle is recocked, to move slide plate 90 to the left, the slide bar 54 is freed to move from the position 60*a* to the position shown at the left end of slot 62.

Accordingly it is seen that a relatively simply constructed timing mechanism is provided which will drive slide bar 54 through a predetermined distance, for a predetermined period of time, in order to keep the switch contacts of the switch 50 closed so that the light in the rifle will produce a burst of light for a predetermined period of time.

Although an illustrative embodiment of the present invention has been described herein with reference to the accompanying drawings, it is to be understood that the invention is not limited to that precise embodiment thereof, and that various changes and modifications may be effected therein by one skilled in the art without departing from the scope or spirit of this invention.

What is claimed is:

1. A timing mechanism for controlling actuation of a switch or the like for a predeterimed period of time, said mechanism including a housing, a gear rack slidably mounted in said housing for movement between first and second positions and located to control said switch during a portion of such movement, means for biasing said rack to said first position; means for propelling said rack from said first position to said second position against the bias of said biasing means and inertia means driven by said rack during movement of the rack from its first to its second position for resisting movement of the rack under the influence of said biasing means from said second to said first position whereby the time period during which the rack is engaged with the switch is controlled.

2. A timing mechanism for controlling actuation of a switch for a predetermined period of time, said mechanism comprising, a housing, a switch actuating member movably mounted in said housing for movement between first and second positions, said member being located to engage said switch during a portion of such movement, means for biasing said member to said first position; means for driving said member from said first to said second position against the bias of said biasing means; and inertia means operatively engaged with said member and driven thereby during movement of the member from its first to its second position for resisting movement of said member under the influence of said biasing means from said second to said first position thereby to control the time period during which said member is engaged with said switch.

3. A timing mechanism as defined in claim 2 wherein said inertia means comprises a rotatable flywheel drivingly engaged with said member.

4. A timing mechanism as defined in claim 3 wherein said flywheel is rotatable about an axis eccentric to the central axis of the flywheel.

5. A timing mechanism as defined in claim 2 wherein said biasing means comprises a spring.

6. A timing mechanism as defined in claim 2 wherein said member is slidably mounted in said housing.

7. A timing mechanism as defined in claim 6 wherein said member is an elongated bar having a rack of gear teeth formed on one side thereof.

8. A timing mechanism as defined in claim 7 wherein said inertia means comprises a rotatably flywheel drivingly engaged with said gear teeth for rotation by said rack as the rack moves from its first to its second position whereby the rotation of the flywheel retards return of the rack from said second to said first position under the influence of said biasing means.

9. A timing mechanism as defined in claim 8 wherein said flywheel is rotatable about an axis eccentric to the central axis of the flywheel.

10. A timing mechanism as defined in claim 2 wherein said housing and member include cooperating means defining limits for said first and second positions of the member.

11. A timing mechanism as defined in claim 10 wherein said cooperating means comprises an elongated slot formed in said housing having opposed closed ends and an abutment on said member extending through said slot for respectively engaging said ends at said first and second positions of the member.

12. A timing mechanism as defined in claim 2 wherein said means for driving said member includes a slide element slidably mounted in said housing for movement between first and second positions; spring means for biasing said element towards said second position thereof; latch means for releasably latching said slide element in its first position; means for moving said slide element from its second to its first position; and means for selectively releasing said latch means to release the slide element to permit movement thereof under the influence of said spring means from the first to the second position thereof; said slide element means engaging said member at the first position of the member during at least a portion of the movement of the slide element from its first to its second position, thereby to drive the switch actuating member from its first to its second position.

13. In a toy gun for use in a target shooting game, said gun including a housing, a light source in said housing, a power supply connected to said light source, normally open switch means operatively connected between said power supply and light source; and switch control means for closing said switch means for a short predetermined period of time thereby to produce a short burst of light of predetermined duration, wherein the improvement comprises said switch control means including an elongated switch control bar slidably mounted in said housing for movement between first and second positions with respect to said switch and being located to contact and close said switch during a predetermined portion of the bar's movement between its first and second positions; spring means for biasing said bar to its first position; means for driving said switch control bar from its first to its second position against the bias of said spring means; and inertia means operatively engaged with said slide bar and driven thereby during movement of the slide bar from its first to its second position for resisting movement of said slide bar under the bias of said spring means whereby the slide bar is maintained in contact with said switch for a predetermined period of time to produce said short burst of light of predetermined duration.

14. In a toy gun as defined in claim 13 wherein said inertia means comprises a flywheel rotatably mounted in said housing and drivingly engaged with said control bar for rotation by the bar during movement of the bar from its first to its second position.

15. In a toy gun as defined in claim 14 wherein said flywheel is rotatable about an axis eccentric to the central axis of the flywheel.

16. In a toy gun as defined in claim 14 wherein said control bar has a rack of gear teeth formed on one side thereof and said switch control means includes gear means operatively engaged between said rack teeth and flywheel to drive the flywheel in response to movement of the control bar.

17. In a toy gun as defined in claim 16 wherein said housing and member include cooperating means defining limits for said first and second positions of the member.

18. In a toy gun as defined in claim 17 wherein said means for driving said member includes a slide element slidably mounted in said housing for movement between first and second positions; spring means for biasing said element towards said second position thereof; latch means for releasably latching said slide element in its first position; means for moving said slide element from it second to its first position; and means for selectively releasing said latch means to release the slide element to permit movement thereof under the influence of said spring means from the first to the second position thereof; said slide element means engaging said member at the first position of the member during at least a portion of the movement of the slide element from its first to its second position, thereby to drive the switch actuating member from its first to its second position.

* * * * *